US006532921B2

(12) United States Patent
Sato et al.

(10) Patent No.: US 6,532,921 B2
(45) Date of Patent: Mar. 18, 2003

(54) VALVE TIMING ADJUSTING DEVICE FOR INTERNAL COMBUSTION ENGINE

(75) Inventors: Osamu Sato, Takahama (JP); Taei Sugiura, Anjo (JP); Kenji Kanehara, Toyohashi (JP); Jun Yamada, Okazaki (JP)

(73) Assignees: Nippon Soken, Inc., Aichi-Pref. (JP); Denso Corporation, Aichi-Pref. (JP)

( * ) Notice: Subject to any disclaimer, the term of this patent is extended or adjusted under 35 U.S.C. 154(b) by 0 days.

(21) Appl. No.: 09/985,806

(22) Filed: Nov. 6, 2001

(65) Prior Publication Data

US 2002/0062803 A1 May 30, 2002

(30) Foreign Application Priority Data

Nov. 30, 2000 (JP) ..... 2000-365573

(51) Int. Cl.[7] ..... F01L 1/34

(52) U.S. Cl. ..... 123/90.17; 123/90.12; 123/90.15; 123/90.31; 464/1; 464/2; 464/160

(58) Field of Search ..... 464/1, 2, 160; 123/90.12, 90.15, 90.17, 90.31

(56) References Cited

U.S. PATENT DOCUMENTS 5,645,017 A * 7/1997 Melchior ..... 123/41.15
5,836,277 A * 11/1998 Kira et al. ..... 123/90.17
6,155,221 A * 12/2000 Ushida ..... 123/90.17
6,302,072 B1 * 10/2001 Sekiya et al. ..... 123/90.17

FOREIGN PATENT DOCUMENTS

JP 10030411 A * 2/1998 ..... F01L/1/34
JP 10037721 A * 2/1998 ..... F01L/1/34
WO WO 99/49187 9/1999

* cited by examiner

*Primary Examiner*—Thomas Denion
*Assistant Examiner*—Ching Chang
(74) *Attorney, Agent, or Firm*—Nixon & Vanderhye PC

(57) ABSTRACT

It is an object to provide a continuously variable valve timing adjusting device to improve valve timing advance response for an internal combustion engine. The device, capable of continuously and variably controlling the intake valve timing phase, includes: an advance chamber which hydraulically rotates a vane rotor and a camshaft on the advance side relative to the timing rotor; a retard chamber for rotating the camshaft on the retard side relative to the timing rotor; an advance-retard oil pressure control valve; an oil communicating passage for fluid communication between the advance chamber and the retard chamber; a hydraulic piston, flow control valve which controls the oil in the communicating passage according to the retard chamber pressure when the engine is running at a low speed and a high oil temperature; and a ball valve check valve which checks the oil flow from the advance chamber to the retard chamber.

8 Claims, 12 Drawing Sheets

VALVE TIMING ADJUSTING DEVICE FOR INTERNAL COMBUSTION ENGINE

CROSS REFERENCE TO RELATED APPLICATION

This application is based on and incorporates herein by reference Japanese Patent Application No. 2000-365573 filed on Nov. 30, 2000.

BACKGROUND OF THE INVENTION

1. Field of the Invention

The present invention relates to a valve timing adjusting device which can perform continuously variable control of the phase of the opening-closing timing of an intake valve or an exhaust valve driven by a camshaft of an internal combustion engine and, more particularly, to a hydraulic vane-type continuously variable valve timing system.

2. Description of Related Art

In general, vane-type continuously variable valve timing adjusting devices which can perform continuously variable control of the phase of intake or exhaust valve timing of an internal combustion engine are known. The variable control is carried out in accordance with a phase difference caused by relative rotation between a timing chain and a chain sprocket by driving a camshaft through a timing pulley and the chain sprocket which rotate in synchronization with a crankshaft of an internal combustion engine.

The vane-type continuously variable valve timing system is provided with a hydraulic servo system such as an advance hydraulic chamber and a retard hydraulic chamber in the inner peripheral wall of a timing pulley. The servo system causes the hydraulic rotation of a vane rotor as one body with a camshaft to the advance side or the retard side, thereby changing the phase of the intake or exhaust valve opening-closing timing. An oil pump is generally adopted and driven to rotate synchronously with the engine crankshaft to produce an oil delivery proportional to the engine speed. The pump also serves as an oil pressure source for supplying the oil pressure to the advance hydraulic chamber and the retard hydraulic chamber.

When the engine is operating at a low speed, the oil delivery from the oil pump decreases. Therefore, a problem arises in that, especially at a low engine speed and at a high oil temperature, oil leakage increases due to lowered oil viscosity. This lowered oil pressure results in substantially decreased oil pressure to be supplied to, and discharged from, the advance hydraulic chamber and the retard hydraulic chamber and, accordingly, in incomplete operation of the vane rotor which has a plurality of vanes on the outer periphery. Previously, in the prior art, technology such as JP-A 11-336516 has been proposed for the purpose of improving response by a mechanism for controlling the vane oscillation during operation at a low engine speed. According to this prior art, a plunger and check valve mechanism are employed to control vane oscillation.

The oil pressure accumulated in the plunger is held by the check valve to prevent reverse rotation of the vane during oscillation when the engine is operating at a low speed. The valve timing adjusting device of the prior art, however, has the problem that, despite its simple construction, the increased number of plungers will increase the number of parts and the manufacturing cost.

At a high oil temperature, at which an improvement in phase response is required, the amount of oil leakage increases, causing the valve timing adjusting device to improperly operate under the condition that the phase response needs improvement, and accordingly no sufficient effect is achievable. Furthermore, to hold the vane in the intermediate phase, the oil pressure must be balanced. However, because the vane is loaded by the plunger which is independent of the hydraulic servo system, oil pressure balance can not be established, and accordingly the vane will be unstable in the intermediate phase.

SUMMARY OF THE INVENTION

Paying attention to changes in oil pressure in a retard hydraulic chamber which are likely to occur with vane oscillation caused by operation of an intake or exhaust valve of an internal combustion engine, it is an object of the invention to improve the response of phase conversion, especially to improve the advance response, by using a simple structure and without using a special means for preventing the vane oscillation during engine operation at a low speed and at a high oil temperature.

According to one embodiment of the invention, a communicating passage is formed to communicate with the advance hydraulic chamber and the retard hydraulic chamber, and furthermore, a valve device having a valve body in the communicating passage is provided. Thus the oil pressure supply and discharge means is controlled by utilizing changes in oil pressure in the retard hydraulic chamber at the time of an advancing operation performed with a negative torque, thus supplying oil pressure from the oil pressure source to the advance hydraulic chamber and discharging oil pressure from the retard hydraulic chamber and also moving the oil from the retard hydraulic chamber into the advance hydraulic chamber.

Therefore, even at a low engine speed and at a high oil temperature, the oil flows from the retard hydraulic chamber into the advance hydraulic chamber by the amount of advance caused by the negative torque. That is, of the vane oscillation resulting from torque variation of the camshaft, the amplitude of vane oscillation toward the advance side is utilized to allow the rotation of the vane rotor in the direction of advance. Furthermore, since the amount of oil flowing into the advance hydraulic chamber increases, the advance response can be improved by a simple structure at a low cost without providing a special means for preventing the oscillation of the vane rotor. In this case, it is advisable to adopt a check valve, as the valve device, having a valve body (a ball valve) which checks the outflow of oil from the advance hydraulic chamber to the retard hydraulic chamber.

Furthermore, a flow control valve for controlling the flow rate of oil flowing in the communicating passage in accordance with the oil pressure in the retard hydraulic chamber is provided in the communicating passage which communicates with the retard hydraulic chamber and the advance hydraulic chamber. During advancing operation when the advance hydraulic chamber communicates with the oil pressure source and the retard hydraulic chamber communicates with the drain line, the oil in the retard hydraulic chamber moves into the advance hydraulic chamber by an advance angle through which the vane rotor is advanced by the negative torque. Of the vane oscillation resulting from camshaft torque variations, the amplitude of the oscillation toward the advance side is utilized to move further in the direction of advance. Furthermore, because of a small pressure loss and an increase in the amount of oil flowing into the advance hydraulic chamber, the advance response can be improved.

Continuing, the flow control valve features closing the communicating passage when the oil pressure in the retard hydraulic chamber exceeds a specific value, and also opening the communicating passage when the oil pressure drops below the specific value. Thus, when the engine is operating at a high speed, the amount of oil delivered from the oil pressure source into the advance hydraulic chamber increases, thereby providing a sufficient oil pressure within the advance hydraulic chamber. Therefore, the flow control valve will not open, thereby providing no effect to the hydraulic servo system.

Furthermore, the timing rotor has a cylindrical shoe housing which houses a vane rotor slidably and rotatably mounted on the inner peripheral surface. Formed within the shoe housing are a plurality of approximately opposing trapezoidal shoes circumferentially arranged projecting radially around the inside diameter. On the vane rotor are provided a plurality of approximately sectoral vanes formed substantially opposite in a circumferential direction, projecting radially on the outside diameter side so that they will fit in clearances formed in the circumferential direction of the plurality of shoes. The communicating passage is provided in each shoe of the shoe housing. The communicating passage does not project out of the timing rotor, and therefore the timing rotor is very compact, requiring no special hydraulic piping and thereby reducing costs.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The invention, together with additional objectives, features and advantages thereof, will be best understood from the following description, the appended claims and the following drawings in which:

DETAILED DESCRIPTION OF THE PREFERRED EMBODIMENTS

Figure 1:
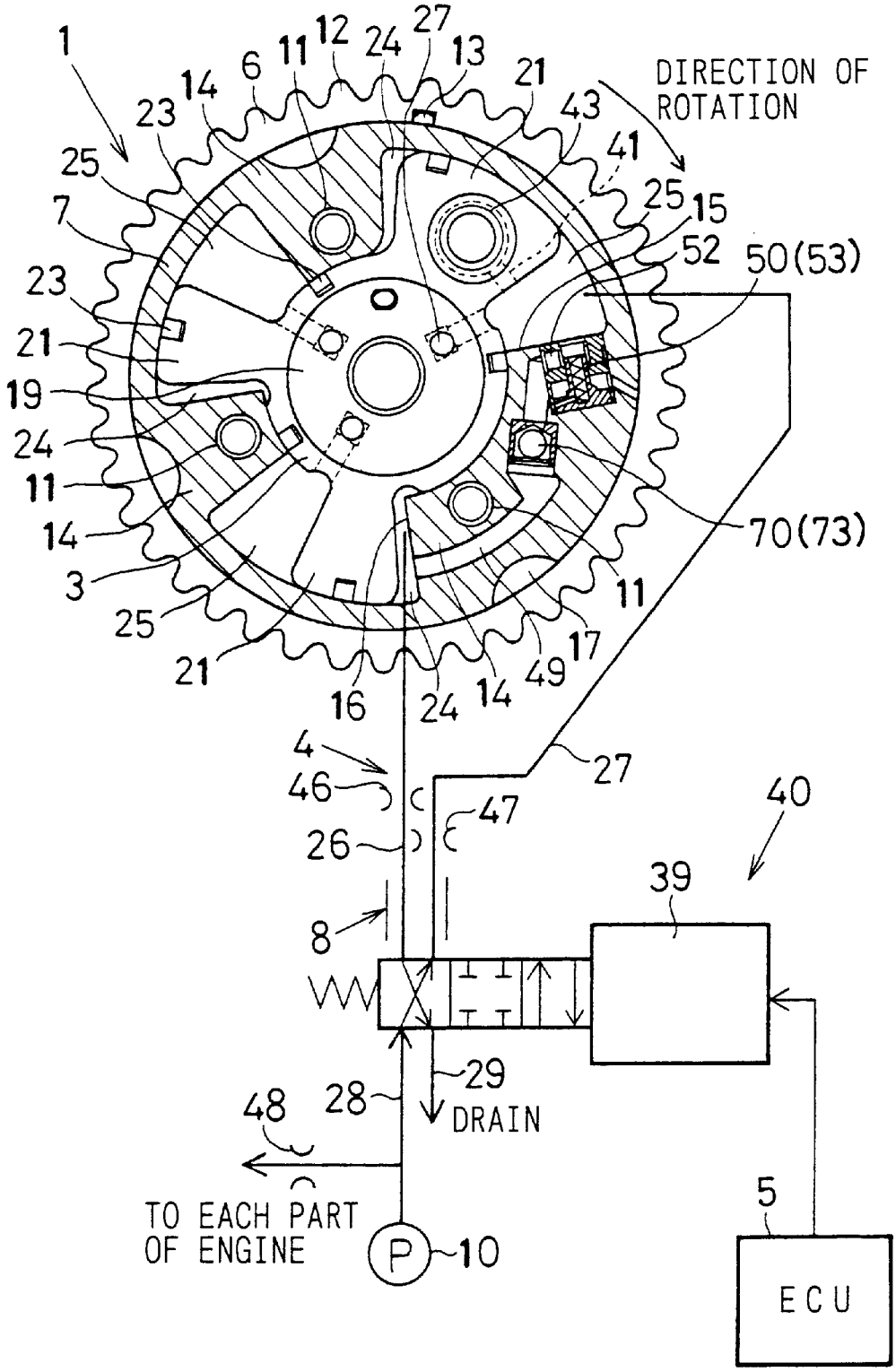
FIG. 1 is a front view showing a continuously variable valve timing adjusting device in an embodiment of the present invention.
Figure 2:
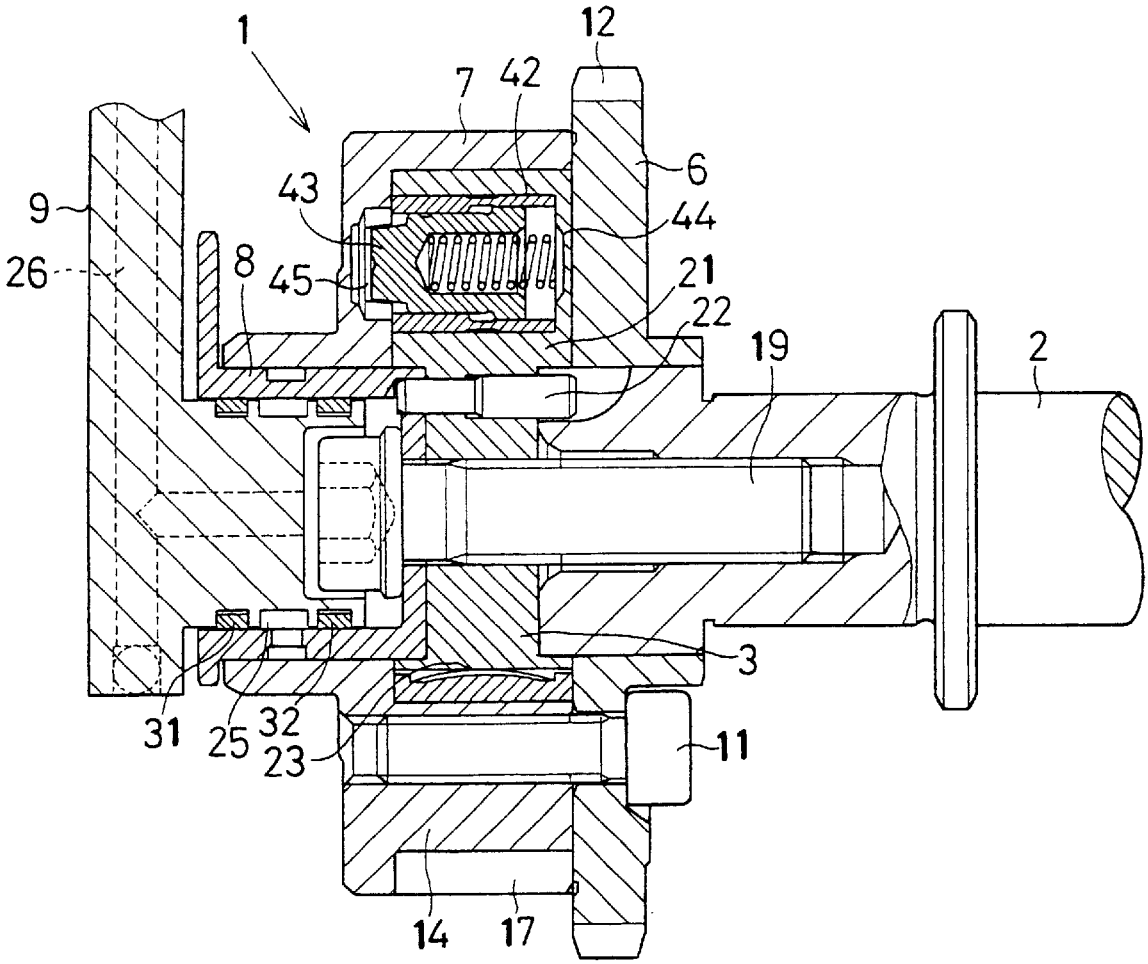
FIG. 2 is a cross-sectional view showing the continuously variable valve timing adjusting device in an embodiment of the present invention.
Figure 3:
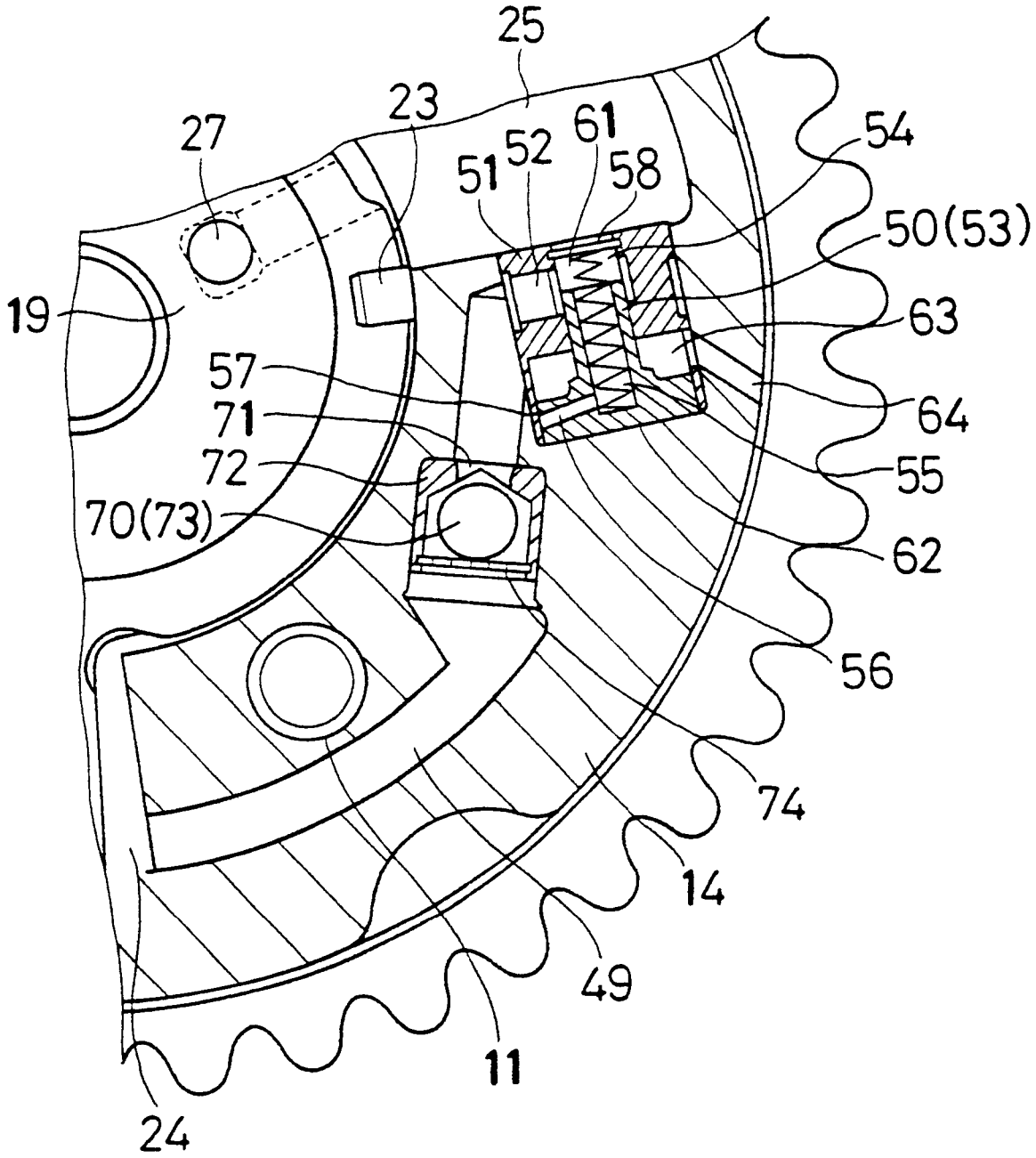
FIG. 3 is a cross-sectional view showing an advance response improving mechanism in an embodiment of the present invention.

FIGS. 1–11 show an embodiment of the present invention. FIGS. 1 and 2 show a continuously variable valve timing adjusting device, and FIG. 3 shows the advance response improving mechanism.

This embodiment presents the continuously variable valve timing adjusting device (continuously variable intake valve timing mechanism: VVT). This device is capable of continuously and variably controlling the phase of valve opening-closing timing (valve timing) of an unillustrated intake valve mounted in an unillustrated cylinder head of a four-cycle reciprocating engine (an internal combustion engine), for example, a DOHC (double overhead camshaft) engine (hereinafter referred to briefly as the engine).

The continuously variable valve timing adjusting device is a vane-type continuously variable valve timing system, which comprises a timing rotor 1 rotatably driven by an engine crankshaft (not shown), an intake-side camshaft 2 (hereinafter referred to as the camshaft) rotatably mounted in relation to the timing rotor 1, a vane rotor 3 secured on the end portion of the camshaft 2 and rotatably housed in the timing rotor 1, a hydraulic circuit 4 for supplying the oil pressure to rotate the vane rotor 3 in normal and reverse directions, and an engine control unit 5 (hereinafter referred to as the ECU) which controls the hydraulic circuit 4.

The timing rotor 1 is comprised of an approximately annular disk-shaped chain sprocket 6 which is rotatably driven by the engine crankshaft by an unillustrated timing chain, an approximately cylindrical shoe housing 7 located at the front end face of the chain sprocket, and three small-diameter bolts 11 for firmly tightening the chain sprocket 6 and the shoe housing 7.

The chain sprocket 6 has on the outer periphery a number of teeth 12 formed to mesh with a number of teeth (not shown) formed on the inner periphery side of the timing bolt. Furthermore, the chain sprocket 6 has, in the annular plate section (which constitutes the rear cover section of the shoe housing 7), three bolt insertion holes for insertion of three small-diameter bolts 11.

The shoe housing 7 is comprised of a cylindrical housing section rotatably housing the vane rotor 3 inside, an annular disk-shaped front cover section which covers the front end side of the housing section, and a cylindrical sleeve section which is extended axially forward from the inner peripheral end of the front cover section. Numeral 13 denotes a positioning pin for positioning the chain sprocket 6 and the shoe housing 7 in the direction of rotation.

The housing section of the shoe housing 7 has a plurality (3 in this example) of trapezoidal shoes 14 (partition wall sections), mutually opposite circumferentially projecting radially on the inner peripheral side. Each face of the shoes 14 is circular in cross section. In a clearance formed circumferentially between two adjacent shoes 14, a sectoral space section is provided. The plurality of shoes 14 have female screw holes in which the three small-diameter bolts 11 are to be installed.

Furthermore, the outer peripheral wall of the vane rotor 3 slides within the inside peripheral wall of the housing section of the shoe housing 7. On one side surface of each shoe 14 in the circumferential direction of each shoe 14, a stopper 15 exists. On the opposite side of each shoe 14, another stopper 16 exists. The stopper 15 is positioned on the retard chamber 25 side relative to the vane 21 and restricts the most advanced position of each vane 21 of the vane rotor 3. Furthermore, stopper 16 is positioned on the advance chamber 24 side relative to the vane 21 of the vane rotor 3 and exists to restrict the most retarded position of each vane 21 of the vane rotor 3. The stopper 16 is formed nearly flush with the outlet of the communicating passage 49 formed in the shoe 14. On the outer peripheral wall of the housing section of the shoe housing 7 are a plurality of recesses 17 formed for weight reduction.

The camshaft 2 is a rod-like shaft located inside of the engine cylinder head and is so coupled as to rotate once per two turns of the engine crankshaft. The camshaft 2 has the same number of cams as the cylinders of the engine, for determining the intake valve timing of the engine, and is secured at one end portion to the vane rotor 3 together with the journal bearing 8 by tightening a large-diameter bolt 19. In the core of one end portion of the camshaft 2 is formed a female screw hole for tightening the large-diameter bolt 19.

The vane rotor 3 is comprised of a plurality of (3 in this example) vanes 21 projecting radially outwardly from the outer peripheral wall of an annular disk-shaped base section having a female screw hole for tightening the large-diameter bolt 19, and a positioning pin 22 for positioning the camshaft 2, the base section, and the journal bearing 8. There are mounted a plurality of seal members 23 between the base section of the vane rotor 3 and the outer peripheral wall of the vane 21, and between the housing section of the shoe housing 7 and the inner peripheral wall of each shoe 14.

The vane rotor 3 is provided with a little clearance between the outer peripheral wall of the plurality of vanes 21 and the inner peripheral wall of the housing of the shoe housing 7. Therefore, the camshaft 2 and the vane rotor 3 can make relative rotation with the chain sprocket 6 and the shoe housing 7 (e.g., at the crank angle (CA) of 40° CA to 60° CA). The vane rotor 3 having the vanes 21 make up, together with the shoe housing 7, a vane-type hydraulic actuator that can continuously change the phase of the intake valve timing of the engine by the use of the oil pressure.

The vanes 21 of the vane rotor 3 are approximately sectoral vanes located mutually oppositely in the circumferential direction, projecting into a sectoral space formed in the circumferential direction between two adjacent shoes 14. An advance hydraulic chamber (hereinafter referred to as the advance chamber) 24 and a retard hydraulic chamber (hereinafter referred to as the retard chamber) 25 are formed between the opposite surfaces of two adjacent shoes 14 and both side surfaces in the circumferential direction of the vane 21 fitted in the sectoral space formed by the two shoes 14. That is, each vane 21 separates the sectoral space formed by two adjacent shoes 14, into two oil-tight hydraulic chambers, thereby forming the advance chamber 24 and the retard chamber 25 on different sides in the circumferential direction of each vane 21.

The hydraulic circuit 4 has a first oil passage 26 (an oil passage on the advance chamber side) for supplying the oil pressure to, or discharging the oil pressure from, each advance chamber 24, and a second oil passage 27 (an oil passage on the retard chamber side) for supplying the oil pressure to, or discharging the oil pressure from, each retard chamber 25. The first and second oil passages 26 and 27 are formed in an oil path forming member 9 fixed on the engine cylinder head. The first and second oil passages 26 and 27 IS are connected to an oil pressure supply path 28 and a drain oil path (drain) 29 through a advance-retard oil pressure control valve (OCV) 40 for switching the passages.

The first oil passage 26 is formed inside of the oil path forming member 9, and further formed between the outer peripheral surface of the journal bearing section of the oil path forming member 9 and the sleeve section of the journal bearing 8. At the front and rear in the axial direction of the first oil passage 26 are mounted seal members 31 and 32. The second oil passage 27 is formed inside of the oil path forming member 9 and further formed in the head section of the large-diameter bolt 19 and the base section of the vane rotor 3.

In the oil pressure supply path 28 is mounted an oil pump (oil pressure source 10) which draws up the oil from the oil pan (not shown), and delivers the oil to each part of the engine. The outlet end of the drain 29 communicates with the oil pan. The oil pump 10 is driven to rotate in synchronization with the rotation of the engine crankshaft, thereby forcing the oil, an amount of which is proportional to the engine speed, to each part of the engine.

Figure 4:
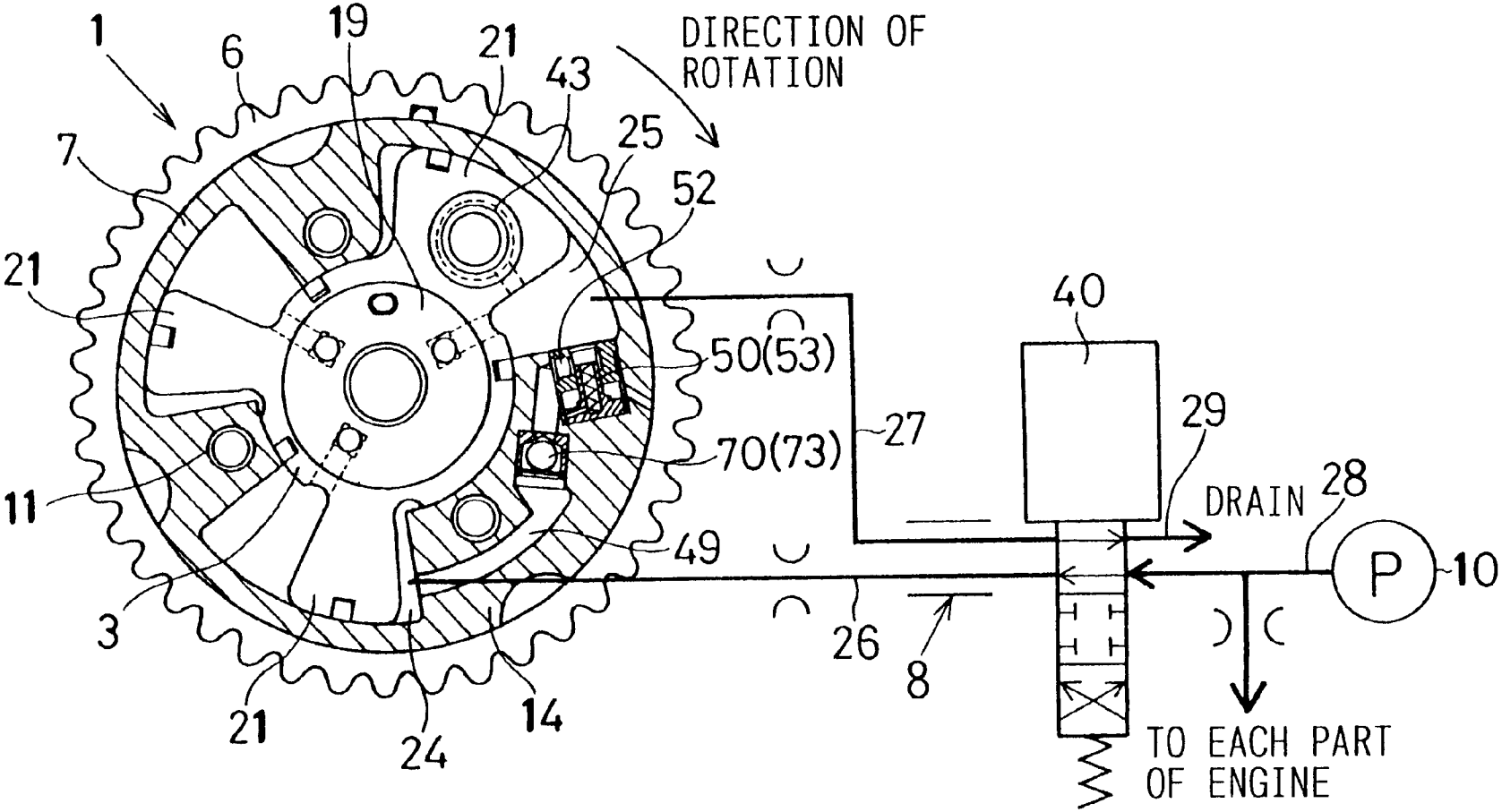
FIG. 4 is an explanatory view showing the control position of a advance-retard oil pressure control valve at the time of advancing operation in an embodiment of the present invention.
Figure 5:
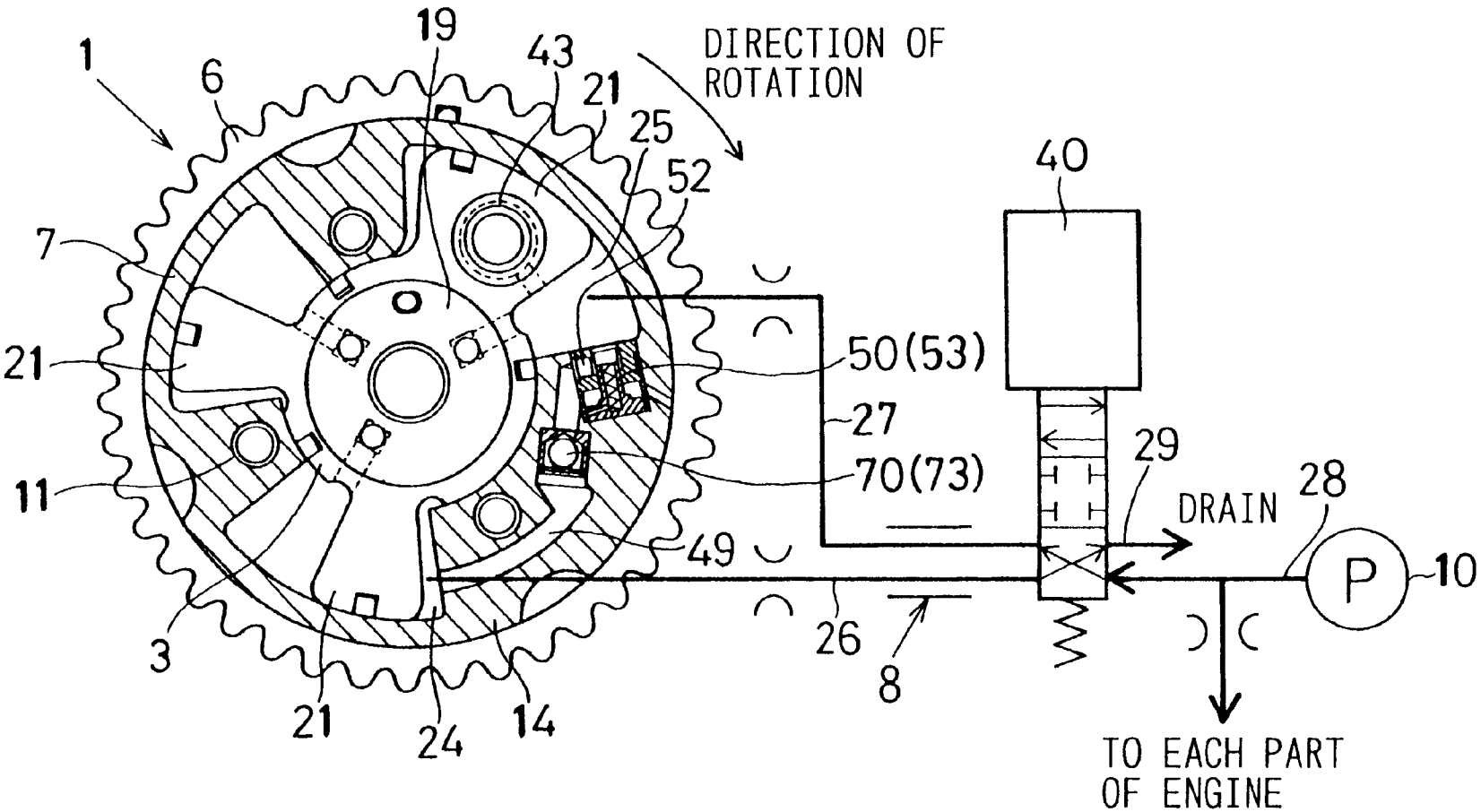
FIG. 5 is an explanatory view showing the control position of the advance-retard oil pressure control valve at the time of retarding operation in an embodiment of the present invention.

The advance-retard oil pressure control valve 40 is a counterpart of the oil pressure supply-discharge means having a four-port, three-position changeover valve (spool valve) and an electromagnetic actuator (solenoid) 39 for driving the changeover valve. As shown in FIGS. 4 and 5, the oil path formed by the sleeve and the spool valve is so constituted as to enable the control of relative changeover between the first and second oil paths 26 and 27 and the oil pressure supply path 28 and the drain 29. The changeover operation is performed by a control signal from the ECU 5 (FIG. 1).

FIG. 4 shows the control position of the advance-retard oil pressure control valve 40 at the time of advancing operation. FIG. 5 shows the control position of the advance-retard oil pressure control valve 40 at the time of retarding operation. In this control position, at the time of the advancing operation, the oil pump 10 communicates with the first oil passage 26, and the drain 29 communicates with the second oil passage 27. When held in the intermediate phase, the oil pressure in the first and second oil passages 26 and 27 is held in the control position. Furthermore, in the control position, the oil pump 10 communicates with the second oil passage 27, and the drain 29 communicates with the first oil passage 26 at the time of the retarding operation.

Now, an oil path 41 communicating with the second oil passage 27 communicates with the retard chamber 25. In the oil path 41 is inserted a hydraulic piston-type stopper pin 43 which axially moves the valve body 42. The stopper pin 43 is applied with a spring force of the spring 44.

When the engine is started, the forward end portion of the stopper pin 43 moves to fit in a recess (fitting portion) 45 formed in the inside wall surface of the front cover section of the shoe housing 7. This state is kept until a sufficient amount of oil pressure is supplied into the retard chamber 25, to position the vane rotor 3 in relation to the shoe housing 7, thereby enabling the shoe housing 7 of the timing rotor 1 to rotate as one body together with the camshaft 2 and the vane rotor 3. When the sufficient amount of oil pressure is supplied into the retard chamber 25, the stopper pin 43 is drawn into the valve body 42 against the spring force, to thereby enable the relative rotation of the shoe housing 7 of the timing rotor 1 together with the camshaft 2 and the vane rotor 3.

Numerals 46 and 47 denote a piping pressure loss in the first and second oil passages 26 and 27. The oil pressure supply path 28 is an oil path for supplying the oil not only to the advance-retard oil pressure control valve 40 but to each part of the engine. Numeral 48 denotes a piping pressure loss in this oil path. The oil pressure supply path 28 communicates with each part of the engine.

Each shoe 14 of the shoe housing 7 is provided with an advance response improving mechanism for improving advance response of the intake valve timing. The advance response improving mechanism of this embodiment is comprised of a communicating passage 49 provided in each shoe 14 of the shoe to housing 7, a flow control valve 50 for regulating the flow rate of oil flowing in the communicating passage 49, and a check valve 70 for checking the outflow of oil from the advance chamber 24 to the retard chamber 25.

The communicating passage 49 is a passage connecting the advance chamber 24 with the retard chamber 25. The inlet of the communicating passage 49 is formed in the side of the retard chamber 25 in the circumferential direction of the shoe 14, while the outlet of the communicating passage 49 is formed in the side of the advance chamber 24 in the circumferential direction of the shoe. 14. In FIG. 1, one of three sets of hydraulic chambers is connected. The other hydraulic chambers are also connected by communicating passages (not shown).

Figure 6:
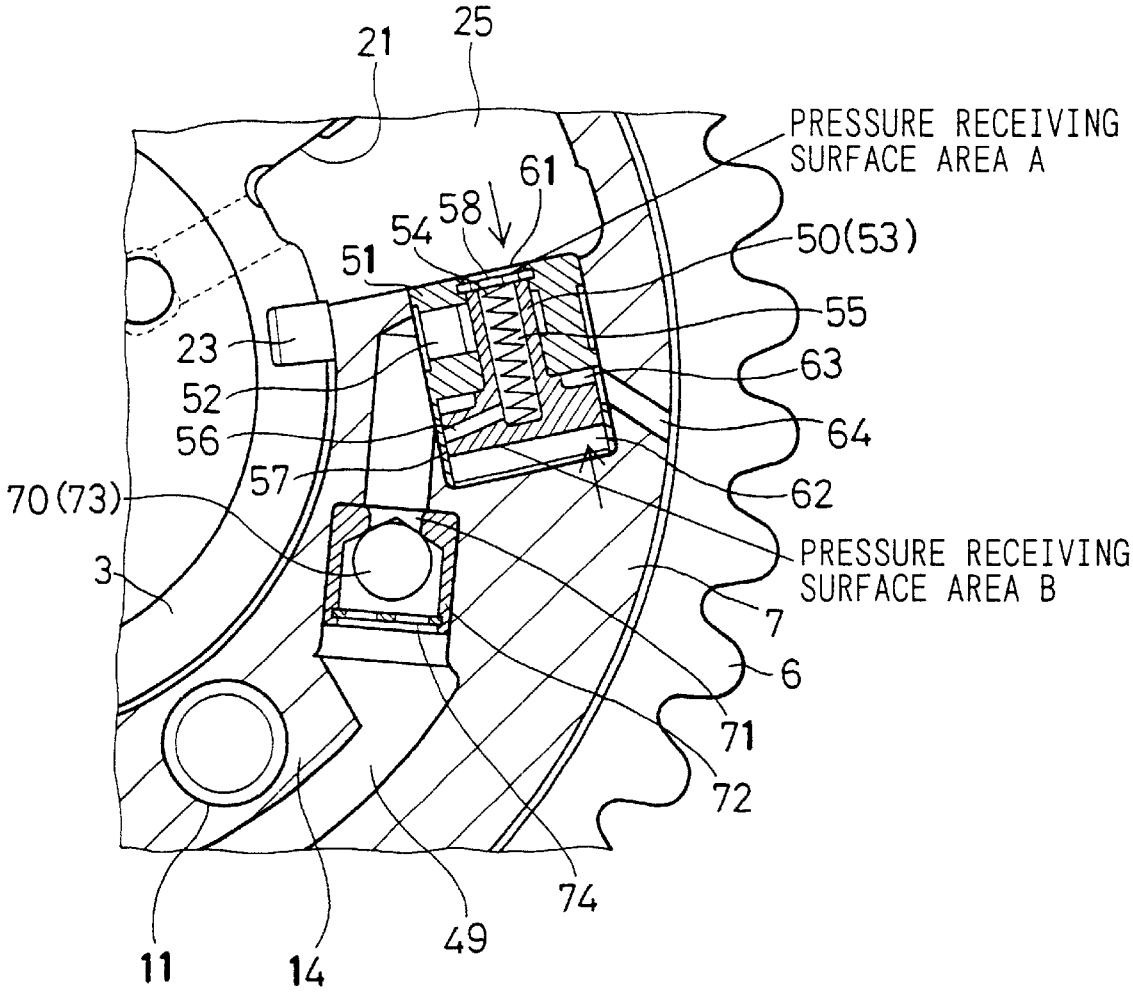
FIG. 6 is an explanatory view showing oil flow when the flow control valve is closed operation in an embodiment of the present invention.
Figure 7:
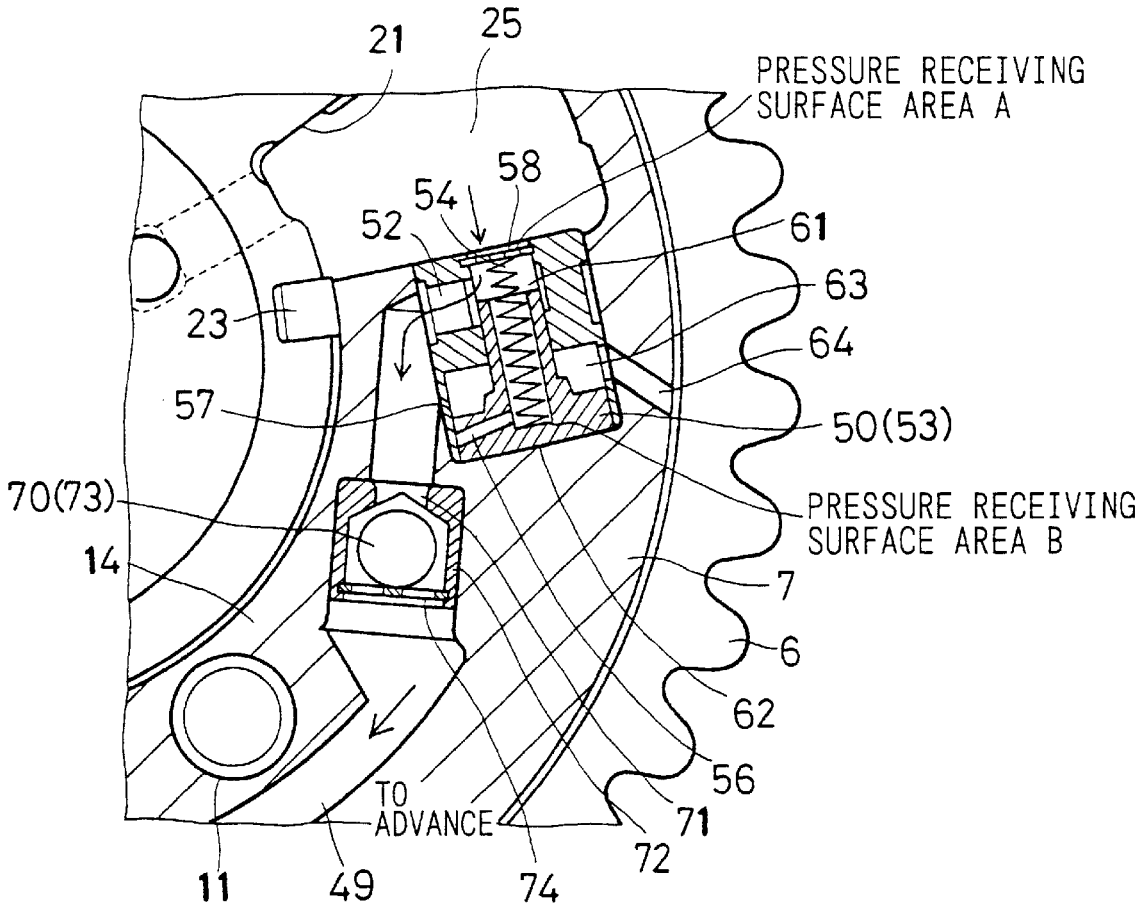
FIG. 7 is an explanatory view showing oil flow when the flow control valve is opened in an embodiment of the present invention.

The flow control valve 50 is comprised of a valve body 51 fixed on the inlet side of the communicating passage 49, that is, in the end of the communicating passage 49 on the retard chamber 25 side, a hydraulic piston 53, which is axially movable in the sliding hole (axial hole) of the valve body 51, and a spring (valve pressing means) 54 capable of applying a specific pressure (spring force) to the hydraulic piston 53. Of these components, the hydraulic piston 53 is a valve body for changing the opening of the oil groove 52 (port communicating with radial oil path) forming the communicating passage 49 as shown in FIGS. 6 and 7.

In the hydraulic piston 53 are formed an axial oil path 55 and a slanting oil path 56. An oil groove 52 is formed in the side (sideward, in radial direction) of the hydraulic piston 53 to communicate with the inside and outside wall surfaces of the sliding hole on the retard chamber 25 side. Then, a specific orifice (fixed aperture) 57 through which the oil can flow is formed between the outer peripheral surface of the flange portion at the illustrated lower end section of the hydraulic piston 53 and the inside surface of the shoe 14. The spring 54 is held at one end by a retainer 58, and at the other end on the bottom of an axial oil path 55 of the hydraulic piston 53. The retainer 58 comprises a number of communicating holes.

Into the front hydraulic chamber 61 of the hydraulic piston 53, the oil pressure is directly drawn in from the retard chamber 25. Into the rear hydraulic chamber (damper hydraulic chamber) 62 of the hydraulic piston 53, the oil pressure is drawn from the retard chamber 25 through an orifice 57. The pressure in the intermediate hydraulic chamber 63 is set to the atmospheric pressure through a drain passage 64. In this embodiment, the surface area (pressure receiving surface area B) of the rear hydraulic chamber (damper hydraulic chamber) of the hydraulic piston 53 is set larger than the surface area (pressure receiving surface area A) of the front hydraulic chamber 61 of the hydraulic piston 53.

Therefore, when the pressure in the retard chamber 25 (retard chamber pressure) exceeds a specific pressure (specific value), the hydraulic piston 53 moves towards the retard chamber 25 side in the axial direction against the spring force of the spring 54. At this time, the oil groove 52 formed in the entire surface of the side of the hydraulic piston 53 is closed to block the communicating passage 49 which connects the advance chamber 24 with the retard chamber 25.

Reversely, if the pressure in the retard chamber 25 (retard chamber pressure) decreases below the specific pressure (specific value), the advance chamber 24 is connected with the retard chamber 25 through the oil groove 52 by the spring force of the spring 54. At this time, the oil is led into the rear hydraulic chamber (damper hydraulic chamber) 62 of the hydraulic piston 53 via the orifice 57. Therefore, the hydraulic piston 53 will not be moved with a change in the oil pressure in the retard chamber 25. That is, the rear hydraulic chamber 62 constitutes the damper means.

The hydraulic piston 53, therefore, is so constructed that it will not react to an oil pressure pulsation, and will open the communicating passage 49 between the advance chamber 24 and the retard chamber 25 only when the oil pressure in the retard chamber 25 has dropped, on average. Furthermore, the valve opening pressure of the hydraulic piston 53 is set so as to open the valve only when the retard chamber is opened to the drain 29, and therefore the retard chamber 25 and the advance chamber 24 are in closed position when each vane 21 of the vane rotor 3 is held in the intermediate phase. According to this mode of operation, therefore, the hydraulic piston 53 will not open thereby maintaining an oil pressure balance, giving no adverse effect to the hydraulic servo system such as the advance chamber 24 and the retard chamber 25.

The check valve 70 is equivalent to the valve device of the invention and, as shown in FIGS. 1, 3, 6 and 7, is located near the advance chamber 24, apart from the flow control valve 50. The check valve 70 includes a valve body 72, a valve hole 71 providing access to the communicating passage 49 between the advance chamber 24 and the retard chamber 25, a ball valve 73 (valve body), which opens and closes the valve hole 71, and a holding member 74 for holding the ball valve 73 on the advance chamber 24 side, apart from the valve hole 71. The holding member 74 is provided with multiple communicating holes.

The ECU 5 detects the current operating condition in accordance with signals fed from a crank angle sensor for detecting the engine speed and from an air flow meter for detecting the engine load and the quantity of intake air, and furthermore detects the relative position of rotation of the timing rotor 1 and the camshaft 2 in accordance with signals from the crank angle sensor and a cam angle sensor. The ECU 5 energizes the solenoid 39 of the advance-retard oil pressure control valve 40 to control the engine intake valve timing to the optimum value in accordance with the engine speed and the engine load.

Next, operation of the continuously variable valve timing adjusting device of this embodiment will be briefly explained by referring to FIGS. 1 to 11. FIG. 6 shows the oil flow when the hydraulic piston 53 of the flow control valve 50 is in a closed position. FIG. 7 shows the oil flow when the hydraulic piston 53 of the flow control valve 50 is in an open position. FIGS. 8A and 8B are timing charts showing the phase and oil pressure behavior, respectively, at the time of slow advancing operation. FIGS. 9A and 9B are timing charts showing the phase and oil pressure behavior, respectively, at the time of a quick advancing operation.

Figure 10:
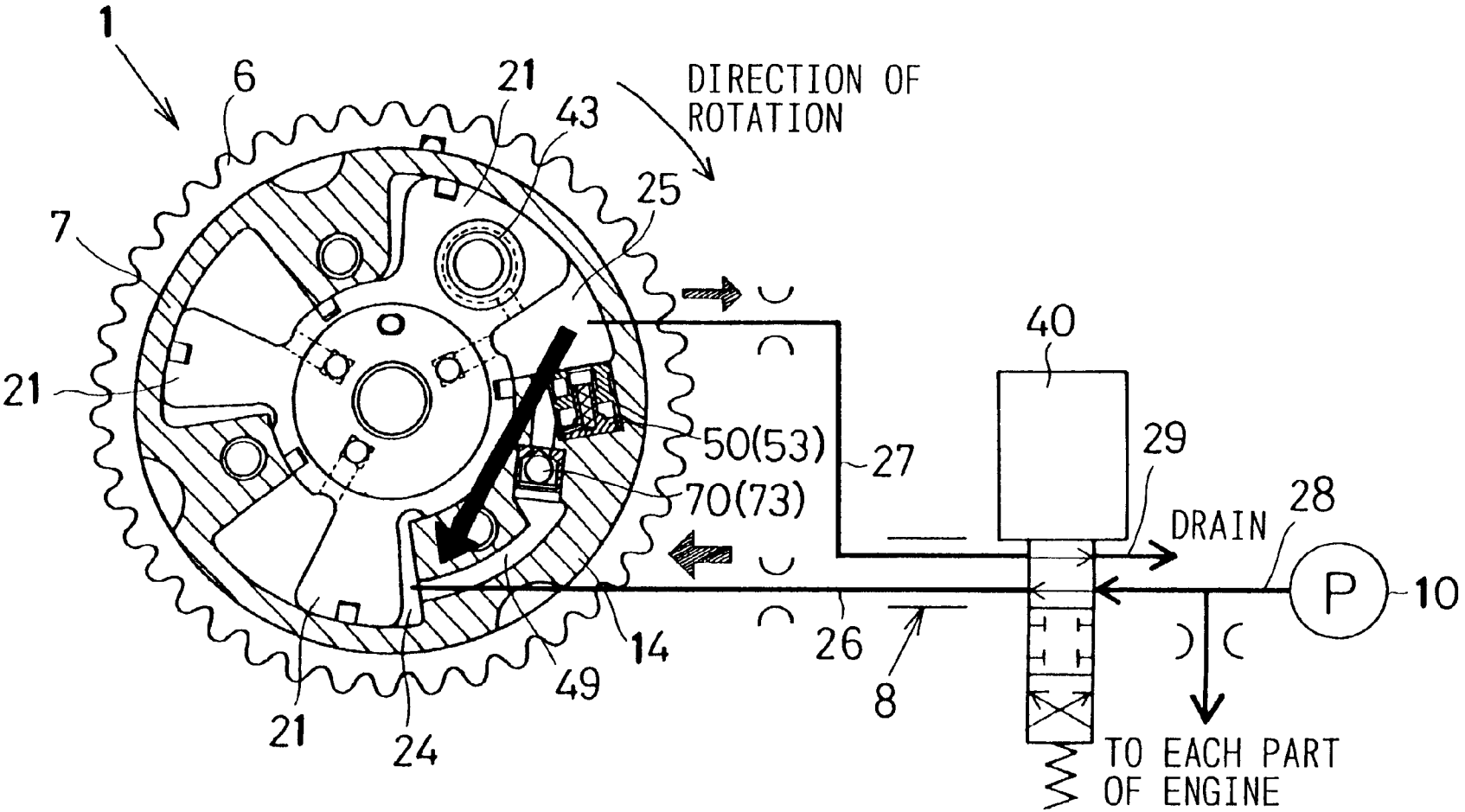
FIG. 10 is an explanatory view showing the operation of the advance-retard oil pressure control valve at the time of slow advancing operation, and the valve opening operation of the flow control valve in an embodiment of the present invention.
Figure 11:
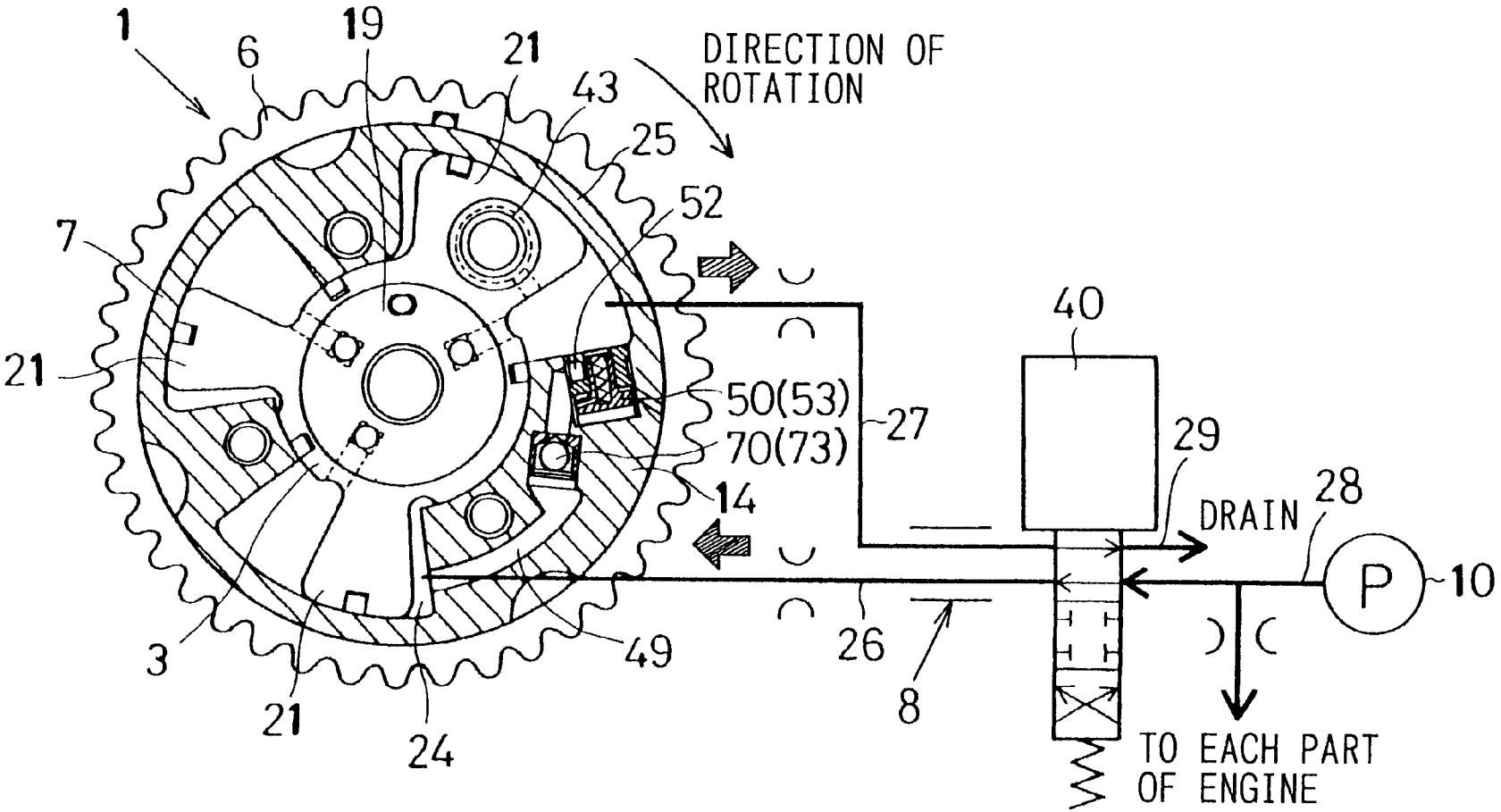
FIG. 11 is an explanatory view showing the operation of the advance-retard oil pressure control valve at the time of quick advancing operation, and the valve closing operation of the flow control valve in an embodiment of the present invention.

Furthermore, FIG. 10 shows operation of the advance-retard oil pressure control valve at the time of slow advancing operation, and operation of the flow control valve in an open position. FIG. 11 shows operation of the advance-retard oil pressure control valve at the time of quick advancing operation, and operation of the flow control valve in an open position. In this case, "the time of slow advancing operation" is meant by the time when no sufficient oil pressure is obtainable because of a low engine speed and a high oil temperature, therefore resulting in a slow advancing operation. Also, "the time of quick advancing operation" is meant by the time when a sufficient oil pressure is achievable during a high engine speed operation and accordingly, a normal advancing operation is performed.

First, an explanation will be made on the response improving control during advancing operation for operating each vane 21 of the vane rotor 3 to the advance side. As shown in FIG. 4, during the advancing operation, the ECU 5 axially moves the spool valve of the advance-retard oil pressure control valve 40, to thereby fluidly link the oil pump 10 and the advance chamber 24 with the first oil passage 26, and then fluidly link the drain 29 with the retard chamber 25 through the second oil passage 27.

Regarding the torque to be applied to each hydraulic chamber (the advance chamber 24 and the retard chamber 25) of each vane 21 of the vane rotor 3, there arises a periodic fluctuating torque between a positive torque for driving the intake valve through the camshaft 2 and a negative torque applied through the intake valve to drive the camshaft 2. At this time, the pressure in the advance chamber 24 (advance chamber pressure) is increased by the positive torque, and the pressure in the retard chamber 25 (retard chamber pressure) is also increased by the negative torque. The pressure in the retard chamber 25 or the advance chamber 24 (retard chamber pressure or advance chamber pressure) on the opposite side of the advance chamber 24 or the retard chamber 25 in which the pressure was increased, will drop because of an increase in capacity.

Figure 8A:
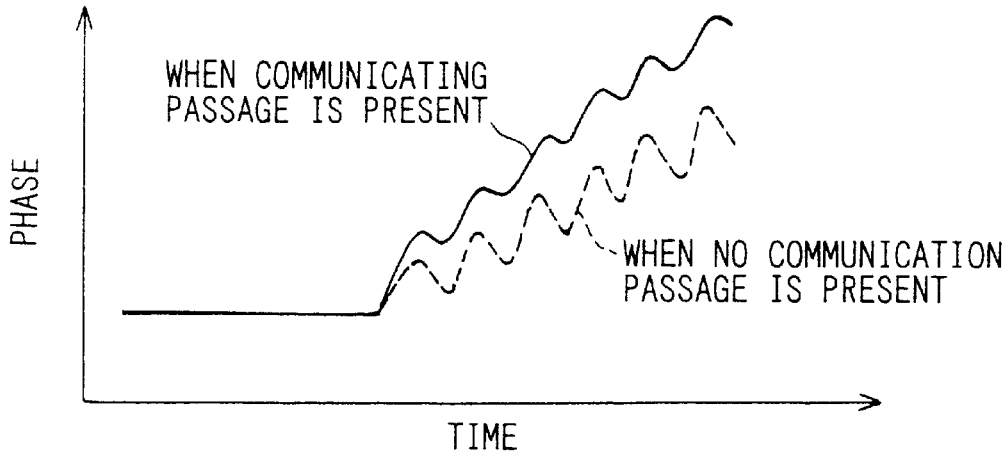
FIG. 8 is a timing chart showing a phase and an oil pressure behavior at the time of slow advancing operation in an embodiment of the present invention.
Figure 8B:
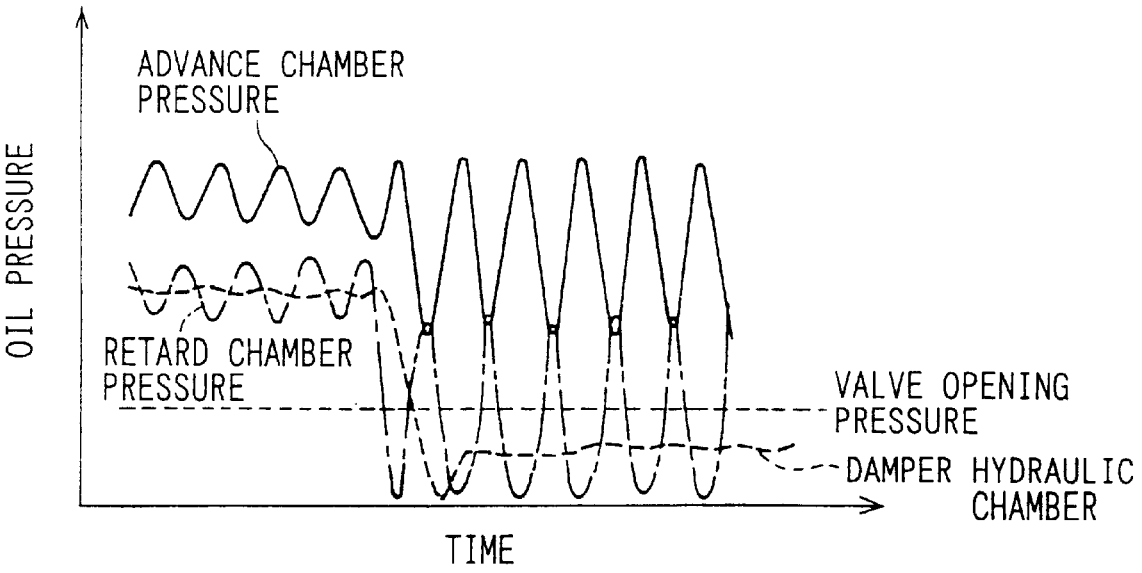

Under such operating conditions as low engine speed (when the engine is operating at a low speed) and high oil temperature, the amount of oil delivered from the oil pump 10 decreases in relation to the oil pressure in the advance chamber 24 as shown in the timing charts in FIGS. 8A and 8B, and the operation explanation view in FIG. 10. Therefore, there is an amount of oil flowing into the advance chamber 24 from the oil pump 10 through the advance-retard oil pressure control valve 40 and the first oil passage 26. With the receiving of the positive torque, the pressure in the advance chamber 24 (advance chamber pressure) increases. However, because oil viscosity lowers when the oil temperature is high, the oil is likely to leak, allowing each vane 21 of the vane rotor 3 to move toward the retard side.

Next, when the negative torque is applied, each vane 21 of the vane rotor 3 moves largely toward the advance side. At this time, the retard chamber 25 is open to the drain 29 through the second oil passage 27 and the advance-retard oil pressure control valve 40. When the oil pressure is discharged through an oil path formed by the sleeve of the advance-retard oil pressure control valve 40 and the spool valve, there arises a pressure loss, resulting in an increased oil pressure in the retard chamber 25. The increased oil pressure, however, will work as resistance in advancing operation, becoming a factor which will restrain the advance response.

Because the pressure in the retard chamber 25 (retard chamber pressure) is lower than the valve opening pressure of the hydraulic piston 53 of the flow control valve 50 at around atmospheric pressure, the hydraulic piston 53 of the flow control valve 50 opens (oil groove 52 is open) to communicate with the aforesaid communicating passage 49. Now, since the pressure in the retard chamber 25 has pulsatively increased as described above, and the pressure in the retard chamber 25 (retard chamber pressure) has dropped, the oil flows in the communicating passage 49 from the retard chamber 25 toward the advance chamber 24. Accordingly, the pressure in the advance chamber 24 (advance chamber pressure) increases, and reversely the pressure in the retard chamber 25 (retard chamber pressure) decreases by the amount of circumferential movement caused by the negative torque.

Next, when the positive torque is applied subsequently to the negative torque, the pressure in the advance chamber 24 (advance chamber pressure) increases, and reversely the pressure in the retard chamber 25 (retard chamber pressure) decreases. Then, as previously stated, the hydraulic piston 53 of the flow control valve 50 is in an open position (oil groove 52 is open), and the oil tends to flow from the advance chamber 24 to the retard chamber 25. In this case, however, the valve hole 51 is closed by the ball valve 73 of the check valve 70 located within the communicating passage 49. Therefore, the flow of oil from the advance chamber 24 to the retard chamber 25 is checked, not allowing the flow of oil in the communicating passage 49 from the advance chamber 24 to the retard chamber 25.

Consequently, when the advance response improving mechanism including the communicating passage 49, the flow control valve 50 and the check valve 70 is used in this manner in this embodiment, each vane 21 moves circumferentially toward the advance side by utilizing the amplitude of oscillation, toward the advance side, of each vane 21 of the vane rotor 3 resulting from changes in the torque of the camshaft 2. Furthermore, because no oil flows from the retard chamber 25 to the advance chamber 24 through the advance-retard oil pressure control valve 40, no pressure loss will occur and the amount of oil flowing into the advance chamber 24 will increase. Accordingly, in this embodiment (when the communicating passage 49 is present), it is possible to largely improve the advance response in comparison to the prior art (when no communicating passage is present) as shown in the timing charts of FIGS. 8A and 8B.

Figure 9A:
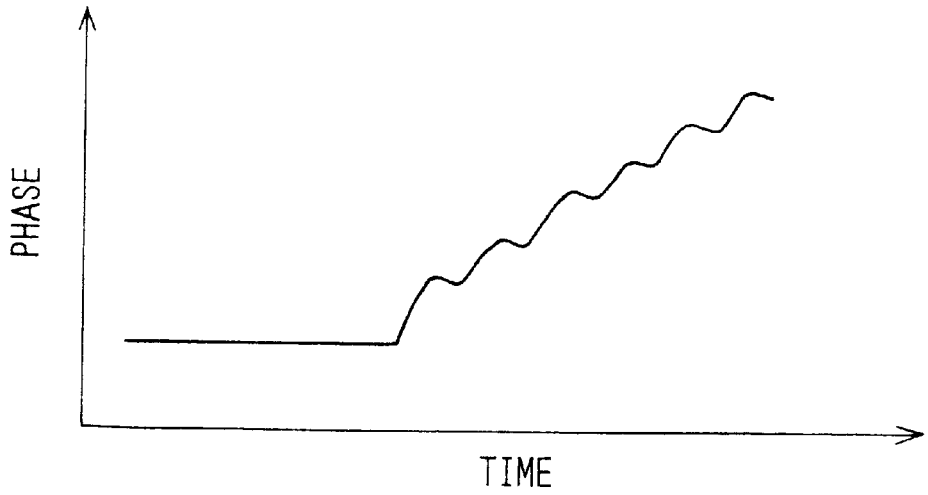
FIG. 9 is a timing chart showing a phase and an oil pressure behavior at the time of quick advancing operation in an embodiment of the present invention.
Figure 9B:
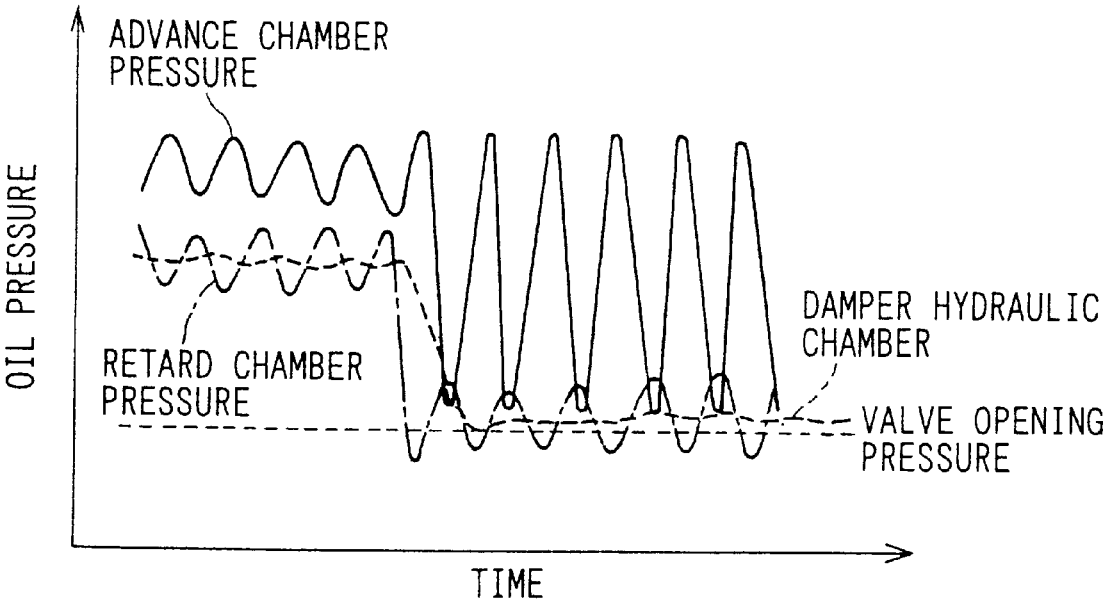

Furthermore, under the condition that the engine is running at a high speed (at a high engine speed), as shown in the timing charts of FIGS. 9A and 9B and the operation view of FIG. 11, the delivery of the oil pump 10 increases and accordingly, a sufficient amount of oil flowing into the advance chamber 24 is obtainable. Therefore, it is unnecessary to control the hydraulic piston 53 of the flow control valve 50. In this embodiment, the surface area (pressure receiving surface area B) of the rear hydraulic chamber (damper hydraulic chamber) 62 of the hydraulic piston 53 is set larger than the surface area (pressure receiving surface area A) of the front hydraulic chamber 61 of the hydraulic piston 53.

Therefore, when the pressure in the retard chamber 25 (retard chamber pressure) has exceeded a specific value, the hydraulic piston 53 moves (to the retard chamber 25 side) against the spring force of the spring 54. At this time, the hydraulic piston 53 closes the oil groove 52, shutting off the communicating passage 49 communicating with the advance chamber 24 and the retard chamber 25. In this case, since an exhaust pressure is built up in the retard chamber 25, the hydraulic piston 53 of the flow control valve 50 is closed (oil groove 52 is closed) as shown in FIG. 6 to FIG. 11, giving no adverse effect to the hydraulic servo system such as the advance chamber 24 and the retard chamber 25.

During the intermediate holding time when each vane 21 of the vane rotor 3 is held in the intermediate phase between the advance side and the retard side, a pressure occurs in the retard chamber 25 (retard chamber pressure) which exceeds the valve opening pressure of the hydraulic piston 53 of the flow control valve 50. It is probable, however, that the retard chamber pressure will be decreased by an oil pressure pulsation below the valve opening pressure of the hydraulic piston 53 of the flow control valve 50. Consequently, during the intermediate holding time when each vane 21 is held in the intermediate phase, the valve timing will advance. The check valve 70 located in the communicating passage 49 operates to maintain the pressure of the advance chamber 24 (advance chamber pressure) and the pressure of the retard chamber 25 (retard chamber pressure).

The hydraulic piston 53 separates the rear hydraulic chamber (damper hydraulic chamber) 62 of the hydraulic piston 53 of the flow control valve 50 from the intermediate hydraulic chamber 63. The hydraulic piston 53 has an orifice 57, so that the amplitude of the oil pressure pulsation can be reduced. Therefore, the above-described problem will not occur. At a low oil temperature, a little amount of oil leaks and the pressure loss caused by the oil viscosity will govern the advance response. Under the condition of low oil temperature, sufficient oil pressure can be supplied to the retard chamber 25 during the advancing operation; therefore, the hydraulic piston 53 of the flow control valve 50 will not open (oil groove 52 will be closed).

Next, in the case the response improving mechanism is applied to the camshaft on the intake side, it is necessary to reduce the EGR gases (residual gases) inside the combustion chamber of each engine cylinder to enhance engine ignition, and accordingly, the vane rotor 3 must be started on the retard side. Therefore, the spool valve of the advance-retard oil pressure control valve 40 is axially moved by the ECU 5, to thereby start the engine to control the advance-retard oil pressure control valve 40 on the retard side.

That is, as shown in FIG. 5, with the oil pressure supply path 28 for supplying the oil pressure from the oil pump 10 connected with the retard chamber 25 through the second oil passage 27, the drain 29 is connected with the advance chamber 24 through the first oil passage 26. At this time, if the hydraulic piston 53 of the flow control valve 50 is in an open position (oil groove 52 is open), the oil delivered from the oil pump 10 into the retard chamber 25 through the second oil passage 27 will probably flow out to the drain 29 through the communicating passage 49 and the advance chamber 24. In this case, therefore, the pressure in the retard chamber 25 (retard chamber pressure) will fail to increase, potentially causing mechanical failures such as impairing the engine bearings (not shown).

In this embodiment, a stopper 16 is positioned on each vane 21 of the vane rotor 3 to assist in determining the most retarded position of the vane 21. When in the most retarded position, the stopper 16 is positioned nearly flush with the outlet port of the communicating passage 49. Therefore, when the engine is started with each vane 21 of the vane rotor 3 positioned in the normal, most retarded phase, each vane 21 closes the outlet port of the communicating passage 49 in a nearly oil-tight fashion. It is, therefore, possible to prevent the outflow of the oil from the inside of the retard chamber 25 through the communicating passage 49 and into the advance chamber 24 if the hydraulic piston 53 of the flow control valve 50 is open (oil groove 52 is open). Thus, a sufficient pressure will be built up in the retard chamber 25 (retard chamber pressure), resulting in lubrication to the engine bearings (and consequently, no damage to the engine bearings).

Figure 12:
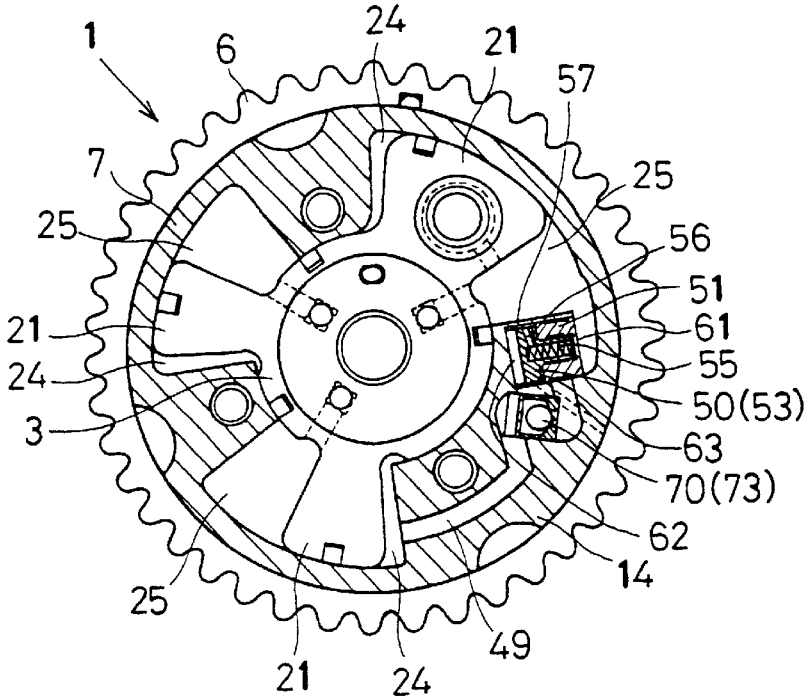
FIG. 12 is a front view showing the continuously variable valve timing adjusting device in an embodiment of the present invention.
Figure 13:
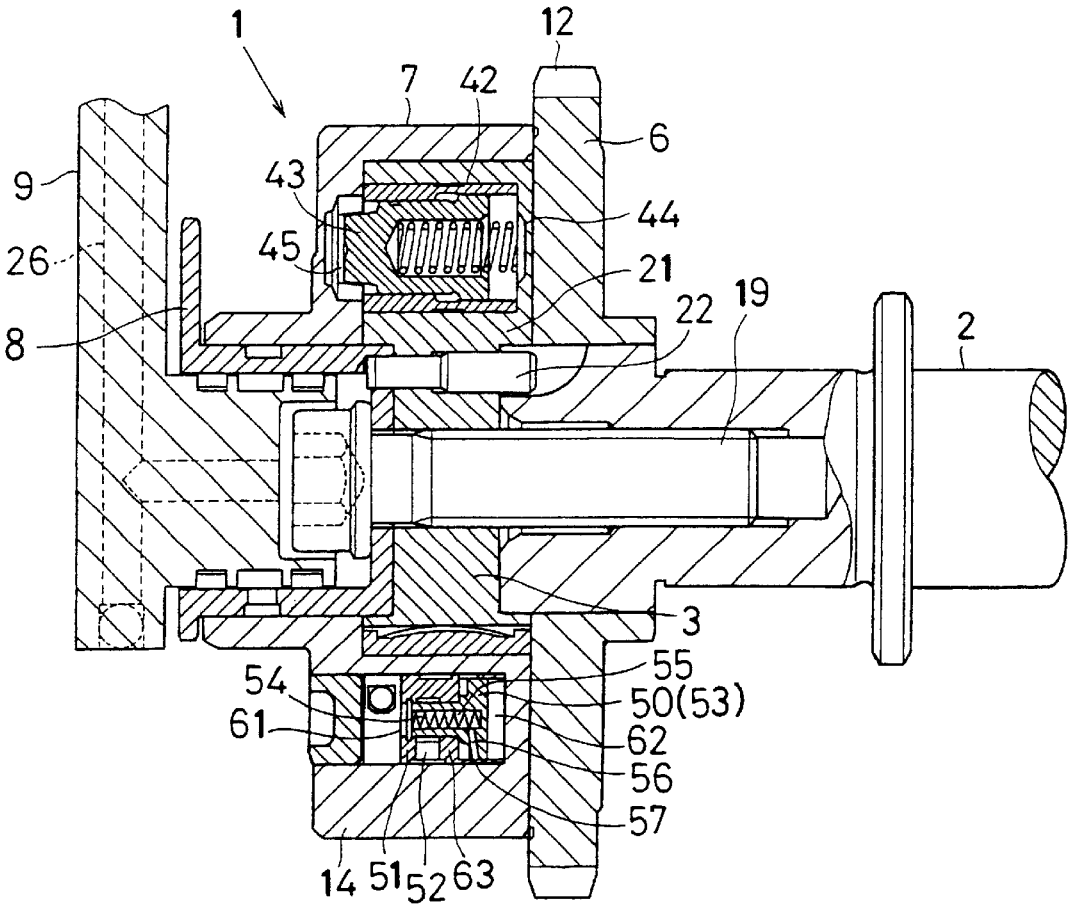
FIG. 13 is a cross-sectional view showing the continuously variable valve timing adjusting device in an embodiment of the present invention.

FIGS. 12 and 13 show second and third embodiments of the invention. FIG. 12 and FIG. 13 are views showing a continuously variable valve timing adjusting device.

In a second embodiment, the flow control valve 50 is mounted, in comparison to the first embodiment, in the radial direction of the shoe housing 7 of the timing rotor 1, the camshaft 2, and the vane rotor 3, and prevents high-speed operation by a centrifugal force. Furthermore, in a third embodiment, the flow control valve 50 is mounted in the axial direction of the camshaft, in relation to the first embodiment, thereby eliminating the effect of the centrifugal force.

In another embodiment, three shoes 14 are formed in the inner peripheral section of the shoe housing 7, and three vanes 21 on the outer peripheral section of the vane rotor 3, thereby providing three advance chambers (advance hydraulic chambers) 24 and three retard chambers (retard hydraulic chambers) 25, to thereby enable continuous changing of the valve timing. It should be noticed that four or more shoes 14 may be formed on the inner peripheral section of the shoe housing 7, and four or more vanes 21 on the outer peripheral section of the vane rotor 3, whereby four or more advance chambers (advance hydraulic chambers) 24 and four or more retard chambers (retard hydraulic chambers) 25 may be provided to continuously change the valve timing. Furthermore, there may be provided two advance chambers (advance hydraulic chambers) 24 and two retard chambers (retard hydraulic chambers) 25 to enable continuous changing of the valve timing.

At engine idle, the intake valve timing of the engine may be largely delayed (retard angle) in order to eliminate the overlap (the timing when the intake and exhaust valves are simultaneously open), to thereby achieve combustion stability. During medium-speed, high-load operation, the intake valve timing may be accelerated (advance angle) to increase the overlapped area to increase the self-EGR gases (residual gases in the combustion chamber), to thereby lower the combustion temperature and consequently to reduce the amount of HC and $NO_2$ to be discharged. In this case, it is possible to decrease pump loss and accordingly to improve fuel economy. Furthermore, during high-speed, high-load operation, the intake valve timing may be delayed (retard angle) to the optimum value to achieve the maximum output.

Furthermore, the actual position of the camshaft 2 is detected to gain a target valve timing, and the advance-retard oil pressure control valve 40 may be feedback controlled to the target valve timing. In this embodiment, the valve timing is continuously variable, but may be changed in two stages or multiple stages on both the advance and retard sides. It is, therefore, possible to apply the invention not only to the continuously variable intake valve timing mechanism but to the continuously variable intake-exhaust valve timing mechanism, or to the continuously variable exhaust valve timing mechanism. Furthermore, the invention may be applied to overhead valve (OHV) engines and overhead camshaft (OHC) engines, both of which are types of internal combustion engines.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A valve timing adjusting device for an internal combustion engine which is capable of variably controlling the phase of intake or exhaust valve timing of the internal combustion engine, comprising:

a timing rotor rotating in synchronization with a crankshaft of the internal combustion engine, a camshaft capable of relative rotation with the timing rotor, a vane rotor rotating integrally with the camshaft, an advance hydraulic chamber for hydraulically rotating the vane rotor, and for rotating the camshaft to an advance side in relation to the timing rotor, a retard hydraulic chamber for hydraulically rotating the vane rotor, and for rotating the camshaft to a retard side in relation to the timing rotor, an oil pressure supply-discharge means for selectively communicating an oil pressure source and a drain with the advance hydraulic chamber and the retard hydraulic chamber, and thereby relatively supplying the oil pressure built up in the oil pressure source to, and discharging the oil pressure from, the hydraulic chamber and the retard hydraulic chamber, a communicating passage for communicating between the advance hydraulic chamber and the retard hydraulic chamber, and a valve device having a valve body inserted in the communicating passage, to enable the outflow of the oil from the retard hydraulic chamber to the advance hydraulic chamber, and to check the outflow of the oil from the advance hydraulic chamber to the retard hydraulic chamber.

2. A valve timing adjusting device for an internal combustion engine as claimed in claim 1, wherein a flow control valve is provided to control the flow rate of oil flowing in the communicating passage in accordance with the oil pressure in the retard hydraulic chamber at the time of advance operation when the advance hydraulic chamber is in communication with the oil pressure source and the retard hydraulic chamber is in communication with the drain.

3. A valve timing adjusting device for an internal combustion engine as claimed in claim 2, wherein the flow control valve closes the communicating passage when the oil pressure in the retard hydraulic chamber exceeds a specific value, and opens the communicating passage when the oil pressure in the retard hydraulic chamber decreases below the specific value.

4. A valve timing adjusting device for an internal combustion chamber as claimed in claim 3, wherein the timing rotor has a cylindrical shoe housing which slidably and rotatably houses the vane rotor on an inner peripheral surface, the shoe housing being provided with a plurality of approximately trapezoidal shoes, radially projecting around the inside diameter side of the show housing, the shoes forming a clearance therebetween;

the vane rotor is provided with a plurality of approximately sectoral vanes, radially projecting on the outside diameter side so as to fit in the clearances formed circumferentially between the plurality of shoes; and wherein the communicating passage is provided in each shoe of the shoe housing.

5. A valve timing adjusting device for an internal combustion engine, the device capable of variably controlling the phase of intake or exhaust valve timing of the internal combustion engine, the device comprising:

a timing rotor rotating in synchronization with a crankshaft of the internal combustion engine, wherein the timing rotor has a cylindrical shoe housing having a plurality of approximately trapezoidal shoes, each shoe radially projecting from the circumferential portion of the cylindrical shoe, the shoes being non-symmetrical in their spacing around the circumference;

a vane rotor having a plurality of vanes, the vanes being located around a hub and projecting radially toward the periphery of the timing rotor, the vanes fitting into clearances created between the shoes of the timing rotor;

an advance hydraulic chamber for hydraulically rotating the vane rotor and a cam shaft of the internal combustion engine;

a retard hydraulic chamber for hydraulically rotating the vane rotor and the cam shaft of the internal combustion engine;

an oil pressure supply-discharge device for hydraulically communicating between an oil pressure source and an oil drain, the oil pressure source and the oil drain communicating through the advance hydraulic chamber and the retard hydraulic chamber; and a fluid communicating passage for fluidly communicating between the retard hydraulic chamber and the advance hydraulic chamber.

6. The valve timing adjusting device of claim 5, further comprising a check valve within the fluid communicating passage.

7. The valve timing adjusting device of claim 6, further comprising a flow control valve, the flow control valve provided to control the flow rate of oil flowing in the communicating passage in accordance with the oil pressure in the retard hydraulic chamber at the time of advance operation when the advance hydraulic chamber is in communication with the oil pressure source and the retard hydraulic chamber is in communication with the drain.

8. The valve timing adjusting device of claim 7, wherein the flow control valve closes the communicating passage when the oil pressure in the retard hydraulic chamber exceeds a specific value, and opens the communicating passage when the oil pressure in the retard hydraulic chamber decreases below a specific value.

* * * * *